United States Patent [19]

Ruo

[11] 4,186,451

[45] Feb. 5, 1980

[54] PLASTIC SANITARY PUMP

[76] Inventor: Chen-Min Ruo, No. 48 Shin Fu Rd., Panchiao City, Taipei, Taiwan

[21] Appl. No.: 909,522

[22] Filed: May 25, 1978

[51] Int. Cl.[2] ..... E03D 11/00; E03D 5/09

[52] U.S. Cl. ..... 4/255; 4/256

[58] Field of Search ..... 4/255, 256, 257

[56] References Cited

U.S. PATENT DOCUMENTS

| | | | |
|---|---|---|---|
| 1,040,276 | 10/1912 | Coleman | 4/255 |
| 1,047,726 | 12/1912 | Yoggerst | 4/255 |
| 1,684,880 | 9/1928 | Norton | 4/255 |
| 2,128,217 | 8/1938 | Anderson | 4/255 |
| 2,456,092 | 12/1948 | Storevik | 4/255 |
| 2,697,842 | 12/1954 | Meyer | 4/255 |
| 3,641,597 | 2/1972 | David et al. | 4/255 |
| 3,934,280 | 1/1976 | Tancredi | 4/255 |

*Primary Examiner*—Henry K. Artis

*Attorney, Agent, or Firm*—Armstrong, Nikaido, Marmelstein & Kubovcik

[57] ABSTRACT

A plastic sanitary pump comprises a cylinder, an elastic disc attached to the bottom of the cylinder, a piston and piston rod, a cap covered on the top of the cylinder and a handle connected with the upper end of the piston rod. All the parts are made of plastic material; therefore, the present invention is light weight and will not rust. It can be operated easily and has excellent effect in releasing the blockage in drain pipe of toilet.

4 Claims, 14 Drawing Figures

FIG. 12
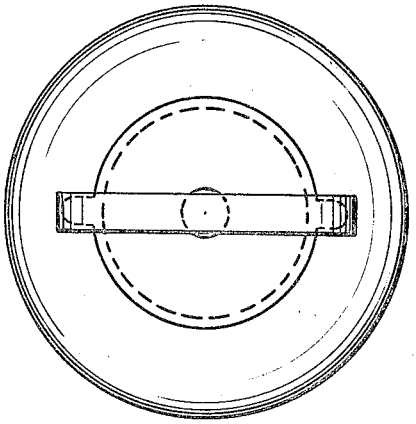
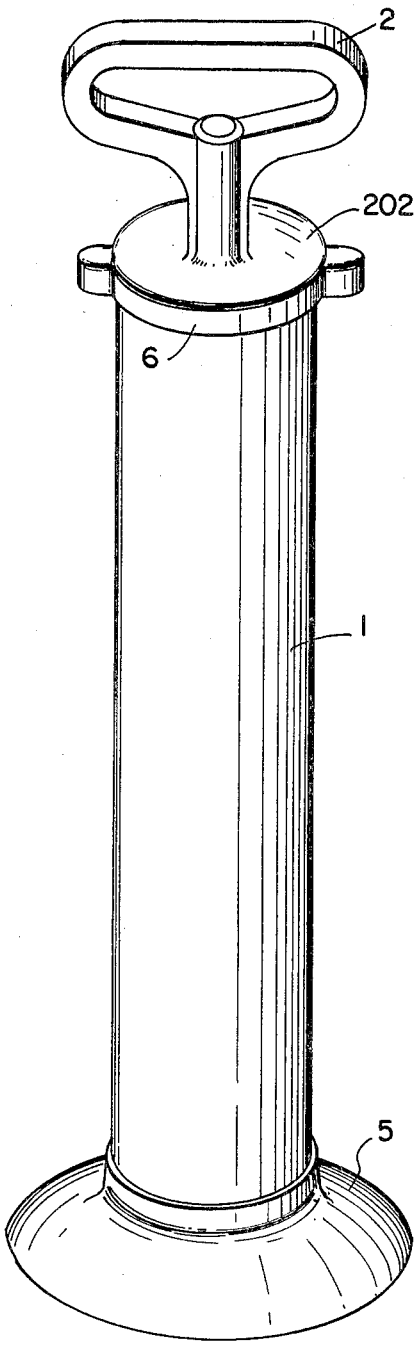
FIG. 1
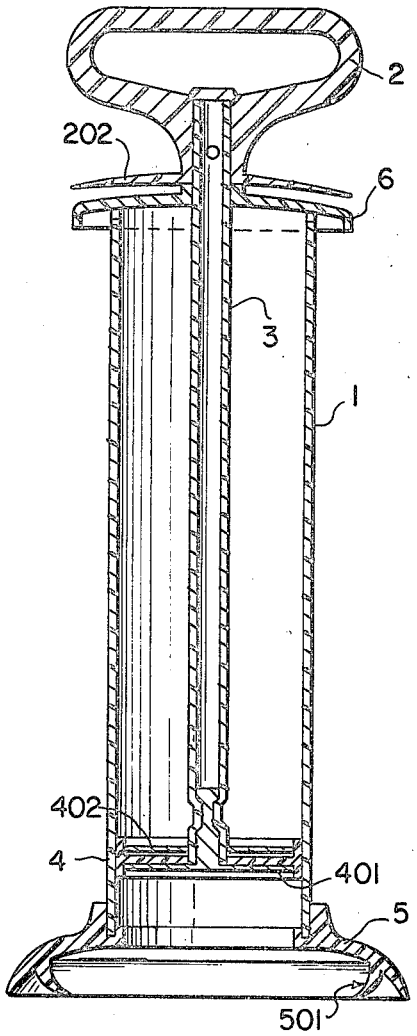
FIG. 2

FIG. 5
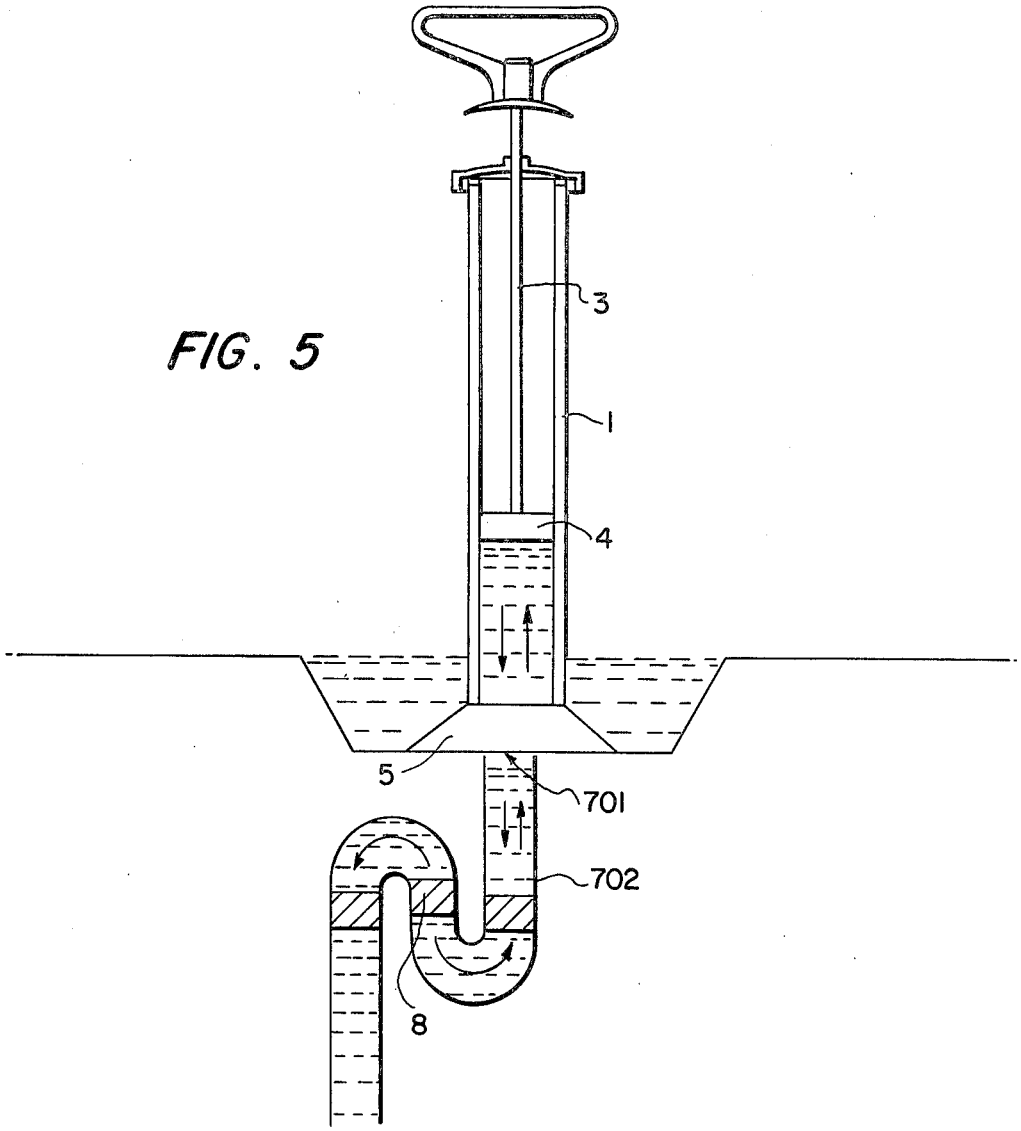
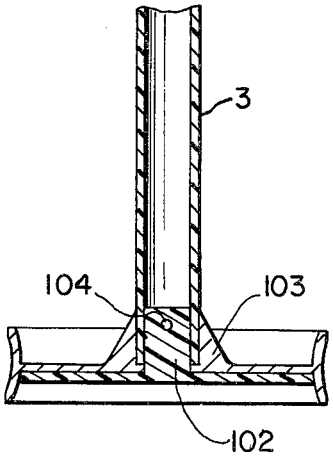
FIG. 6
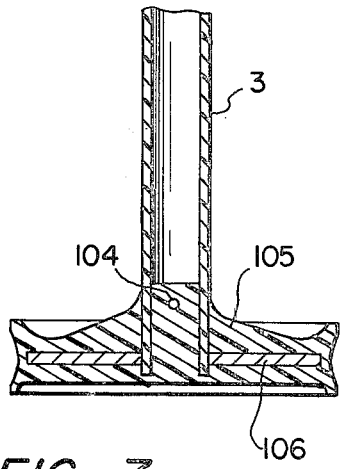
FIG. 7

PLASTIC SANITARY PUMP

BACKGROUND OF THE INVENTION

This invention concerns a plastic sanitary pump, particularly a PVC made embodiment which has a simple structure and can be operated easily to clean and release the blockage in a drain pipe by means of sucking and pressing.

The conventional device only presses the blockage in a drain pipe, but it has no the function of suction, so the blockage is often pressed together, making the condition worse. A new toilet blockage releasing device has been invented (Chinese Pat. Appn. No. 6424220), but it has a complicated structure which has a lot of parts and a high cost. Moreover, most of its parts are made of metal which rust easily, so its life is short.

BRIEF DESCRIPTION OF THE DRAWINGS

FIG. 1 is a perspective view of the present invention.

FIG. 2 is a sectional view of the present invention.

FIG. 5 is a view of the present invention during operation.

FIG. 6 is a sectional view of an example of the piston.

FIG. 7 is a sectional view of another example of the piston.

FIG. 12 is a top view of the present invention.

DETAILED DESCRIPTION OF THE INVENTION

Figure 3:
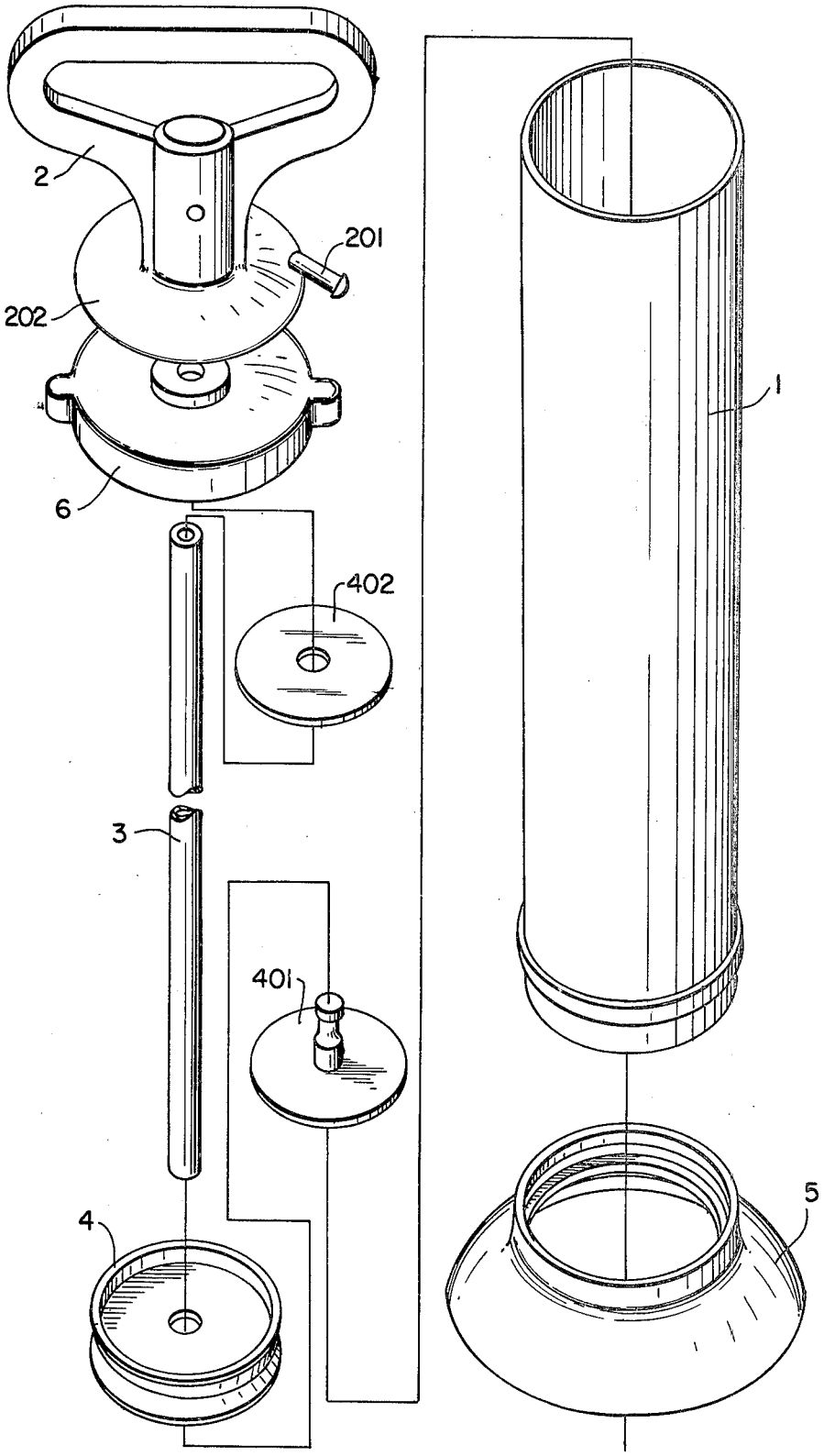
FIG. 3 is a perspective view of parts of the present invention.
Figure 4C:
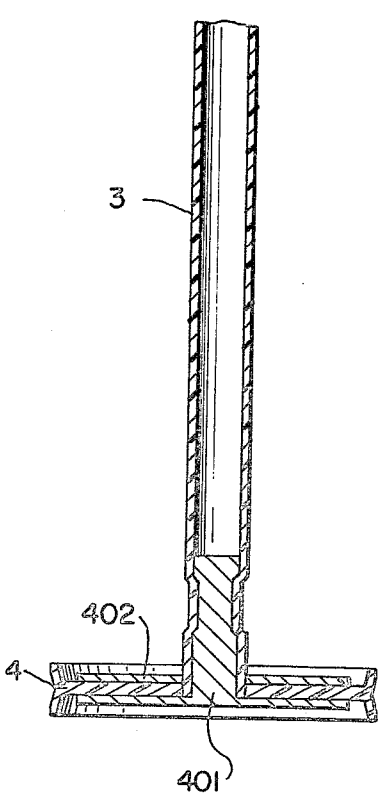
FIGS. 4*a*, 4*b* and 4*c* are illustrations of assembling the piston, washer, washer plug and piston rod.
Figure 4B:
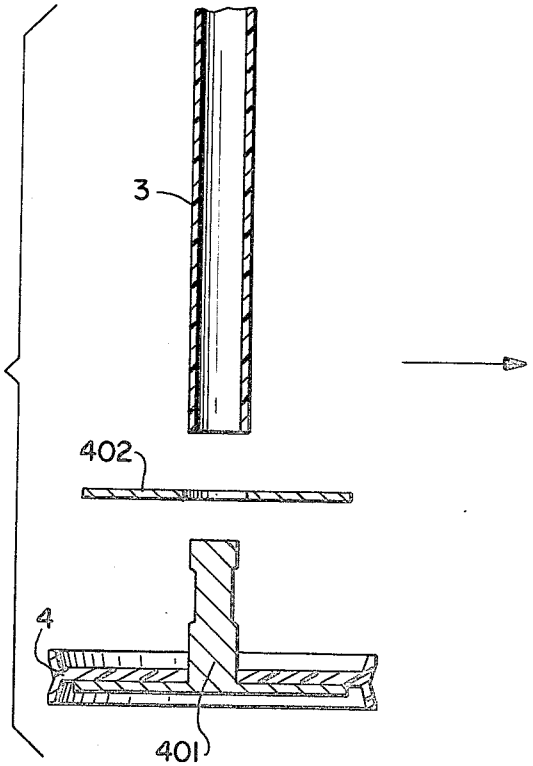
Figure 4A:
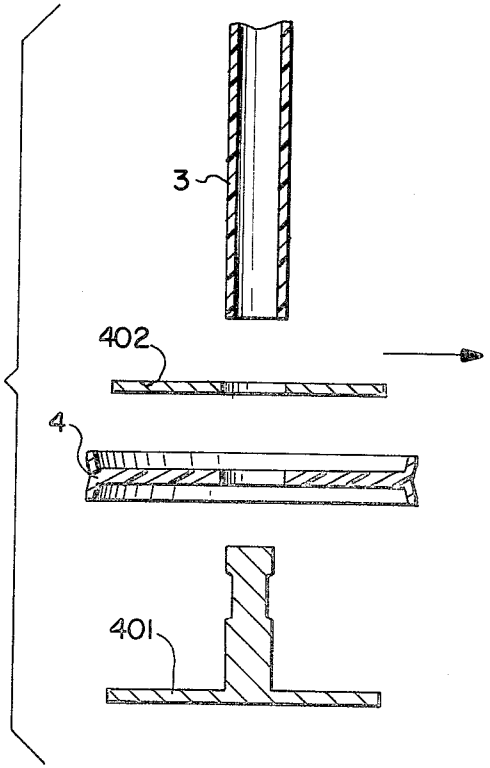

This invention relates to a plastic sanitary pump which is made of PVC plastics or other suitable plastic material by means of extrusion. Owing to the present invention, the pump has a simple structure which can be produced easily and cheaply. Further, the present invention has effectively functions for releasing a blockage in a drain pipe. Referring to the FIGS. 1–3, the present invention comprises the following essential parts: (1) a cylinder, (2) a handle, (3) a piston rod (4) a piston, (5) a elastic disc or flexible sealing cup (6) a cap. All of the parts are made of PVC plastics or suitable plastic material. The piston (4*a*) and elastic disc (5) are elastic. The piston rod (3) is a plastic tube. As shown in FIG. 4, the piston (4) is fixed on washer plug (401) first, then the washer (402) is set on the piston (4). Adhesives may be used between the contact surfaces of these parts to stick them together. After that, the washer plug (401) is inserted into one end of the piston rod (3), then the joint position is heated to make the end of the piston rod (3) fasten on the washer plug (401). The next step is to insert the upper end of the rod (3) into the cap (6), then fix the handle (2) on the upper end with adhesives and rivet (201). Next, insert the embodiment of piston (4), washer plug (401), washer (402), piston rod (3), cap (6) and handle (2), into the cylinder (1) downwardly and adhere the plastic disc (5) on the lower end of the cylinder (1). Finally, fix the cap (6) on the upper end of the cylinder (1) with adhesives, with the handle (2) remaining above the cap (6). Thus, the present invention is finished.

Figure 8:
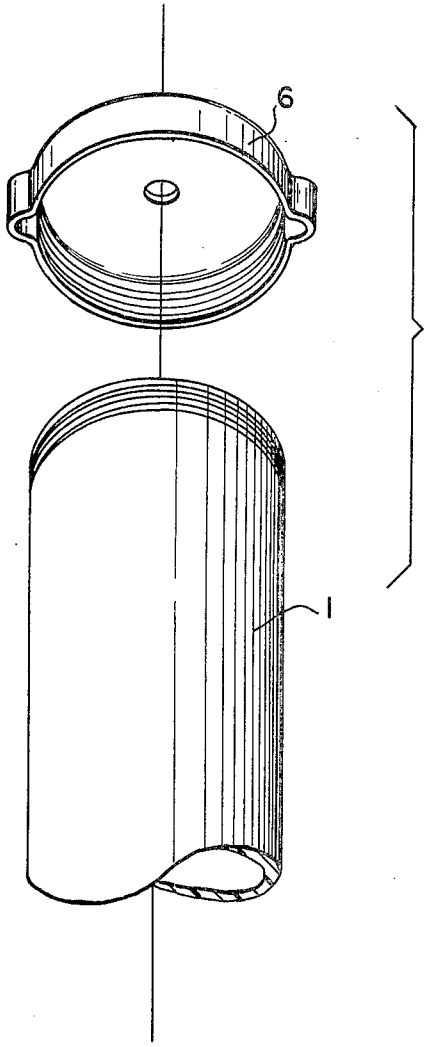
FIG. 8 is a perspective view of the cylinder and its cap having screw thread.
Figure 9:
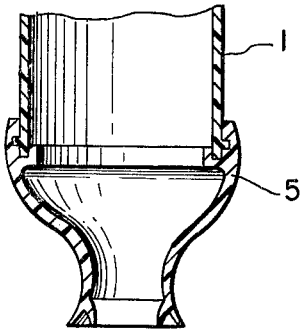
FIG. 9 is a section view of an example of the elastic disc.
Figure 10:
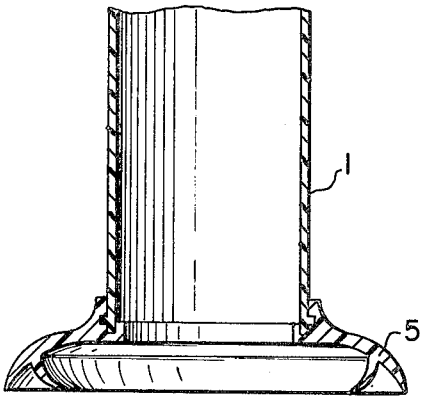
FIG. 10 is a section view of an example of the cylinder and elastic disc.
Figure 11:
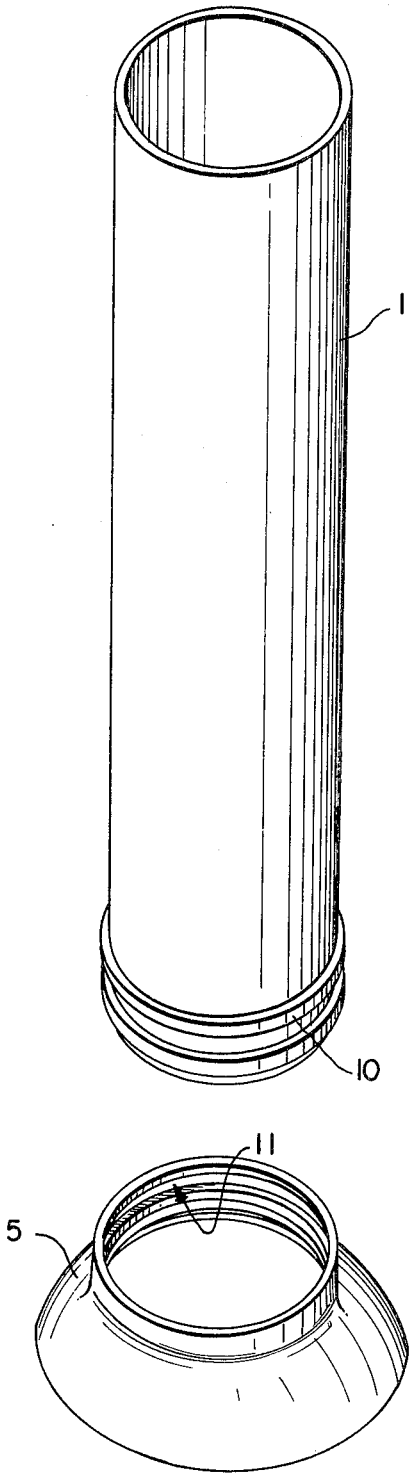
FIG. 11 is a perspective view of an example of the cylinder and elastic disc.

In the above-mentioned structure, the cap (6) is like a bowl which has one or more air outlets on its border. The cap and the upper end of the cylinder can also be screw-coupled together instead of using adhesives (as shown in FIG. 8), and they can be separated for easy cleaning. There is a disc (202) under the handle (as shown in FIG. 8), which prevents the unfavourable water or air from reaching a user's hand while operating the present invention. The elastic disc (5) on the lower end of the cylinder (1) has a shape of a disc or bowl, which includes an inner rim (501) adjacent to its border on the bottom. The border and the inner rim (501) enhance the effect of the air-tight fit during operation. Of course, the inner rim can be increased if necessary. As shown in FIG. 6, the piston (101) can be made with hard plastics (102) and covered by elastic plastic (103), the central plug can be inserted into the piston rod (3) and they may be fixed together with adhesives and rivet (104). Alternatively, the piston (105) may have the structure shown in FIG. 7, which includes a round metal plate (106) in it. The central plug can also be inserted into the piston rod (3) and fix them together with adhesives and pin (104) or screw-coupling. The FIGS. 9, 10 and 11 show the other structures of the lower end of the cylinder (1) and the plastic disc (5). One or more flanges on the lower end of the cylinder (1) may be combined with the corresponding grooves on the top opening of the elastic disc (5). Therefore, the plastic disc (5) may be fixed on or taken off from the end of the cylinder (1) easily. When the present invention is used to treat a drain pipe having a smaller diameter, the elastic disc (5) having a smaller opening on its bottom, as shown in FIG. 9, can be used instead of wider one. When operating the present invention, the handle (2) should be pressed to the end, then the elastic disc (5) is put on the opening (701) of drain pipe (702). The cylinder (1) is held with one hand, and the handle (2) is pulled up and pressed down with the other hand. The piston (4) moves up and down with the handle (2). Therefore, the blockage (8) in the toilet or drain pipe (702) will be sucked and released rapidly. If the blockage (8) is not released completely, the present invention may be moved away and the above-mentioned process repeated again. The present invention can be operated contrary, that is to pull the handle (2) to the end, then put the elastic disc (5) on the opening of drain pipe (702). When said handle is pressed downward, the piston (4) moves down, which presses and releases the blockage (8) in the toilet or drain pipe (702). According to our tests, any blockage in a toilet or drain pipe can be released and cleaned within five seconds. All the parts of the present invention are made of plastic material and the whole embodiment weight is only 0.7 kg. Therefore, the present invention is really a sanitary tool of easy operation, practicality and high efficiency.

I claim:

1. A sanitary pump comprising:

a tubular cylinder having upper and lower openings at each end thereof;

a flexible sealing cup surrounding the lower cylinder opening;

piston means slidably mounted within said cylinder, said piston means comprising a lower rigid washer plug having a flat annular body and a vertically extending centrally positioned post, an upper rigid annular washer having a centrally positioned aperture fitted over said post and a flexible annular piston element sandwiched between said lower washer plug and said upper washer;

a hollow piston rod, said piston means vertical post being mounted within said hollow piston rod and being maintained in place by welding the vertical post to said hollow piston rod;

a handle, said handle being attached to an upper end of said piston rod;

a disc, said disc being positioned under said handle and mounted for movement with said handle for preventing water from reaching a user's hand; and a cap mounted on and partially closing said cylinder upper opening, said cap including at least one air outlet and a central aperture for guiding said piston rod.

2. The sanitary pump as claimed in claim 1, wherein the flexible sealing cup having one or more inner rim(s) adjacent to the border on bottom.

3. The sanitary pump as claimed in claims 1 or 2 characterized in that all the parts are made of plastic material.

4. The sanitary pump as claimed in claims 1, 2 or 3 characterized in that all the parts are made of PVC plastics.

* * * * *